US009085845B2

(12) United States Patent
Choi et al.

(10) Patent No.: US 9,085,845 B2
(45) Date of Patent: Jul. 21, 2015

(54) APPARATUS TO DETECT OPENING AND CLOSING OF DOOR IN WASHING MACHINE

(71) Applicant: SAMSUNG ELECTRONICS CO., LTD., Suwon-si, Gyeonggi-do (KR)

(72) Inventors: Jun Young Choi, Incheon (KR); Weon Jin Song, Suwon-si (KR); Myung Soon Kang, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/287,697

(22) Filed: May 27, 2014

(65) Prior Publication Data

US 2015/0000195 A1 Jan. 1, 2015

(30) Foreign Application Priority Data

Jun. 26, 2013 (KR) ..... 10-2013-0073600

(51) Int. Cl.

| | |
|---|---|
| ***D06F 37/42*** | (2006.01) |
| ***D06F 39/14*** | (2006.01) |
| ***E05B 47/02*** | (2006.01) |
| *E05B 47/00* | (2006.01) |

(52) U.S. Cl.

CPC ..... *D06F 39/14* (2013.01); *D06F 37/42* (2013.01); *E05B 47/026* (2013.01); *E05B 2047/002* (2013.01); *E05B 2047/0048* (2013.01); *E05B 2047/0069* (2013.01)

(58) Field of Classification Search

CPC ..... D06F 39/14; D06F 37/42; D06F 37/28; D06F 2224/00; E05B 47/026; E05B 2047/0069; E05B 2047/002; E05B 2047/0048

USPC ..... 68/12.26, 196; 126/190, 197, 192, 220, 126/273 R, 1 R, 42, 39 BA; 292/DIG. 69

See application file for complete search history.

(56) References Cited

U.S. PATENT DOCUMENTS

| | | | | |
|---|---|---|---|---|
| 3,713,226 | A * | 1/1973 | Takeyama et al. | 34/562 |
| 3,892,933 | A * | 7/1975 | Rocchitelli | 337/77 |
| 3,924,085 | A * | 12/1975 | Stone | 200/61.62 |
| 5,520,026 | A * | 5/1996 | Ackland | 68/12.26 |
| 5,879,036 | A * | 3/1999 | Moline et al. | 292/210 |
| 5,896,759 | A * | 4/1999 | Barrena et al. | 68/12.26 |
| 7,493,783 | B2 * | 2/2009 | Hapke et al. | 68/12.26 |

(Continued)

FOREIGN PATENT DOCUMENTS

| | | |
|---|---|---|
| JP | 2000-5098 | 1/2000 |
| KR | 20-1997-0009943 | 3/1997 |
| KR | 10-1999-0003083 | 1/1999 |

*Primary Examiner* — Katherine Mitchell
*Assistant Examiner* — Justin Rephann
(74) *Attorney, Agent, or Firm* — Staas & Halsey LLP

(57) ABSTRACT

An apparatus to detect opening and closing of a door in a washing machine by detecting a resistance value varying according to a lever position of a door lock switch. In the apparatus to detect opening and closing of a door in a washing machine, since a resistance meter is added to the inside of a component with the contact being eliminated therefrom, it may be possible to simplify an inner structure of the component and to reduce material costs. In addition, opening and closing of a door is accurately detected as a resistance value of the resistance meter varies by rotation of a gear instead of surface contact between contacts, and thus it may be possible to prevent a detection error in the event of contact short circuits due to moisture and to enhance component reliability.

16 Claims, 5 Drawing Sheets

(56) References Cited

U.S. PATENT DOCUMENTS

| | | | | |
|---|---|---|---|---|
| 8,006,521 | B2 * | 8/2011 | Rocchitelli | 68/12.26 |
| 8,215,135 | B2 * | 7/2012 | Hapke et al. | 68/12.26 |
| 2003/0012625 | A1 * | 1/2003 | Rosenquist | 414/217.1 |
| 2007/0209411 | A1 * | 9/2007 | Lim et al. | 70/263 |
| 2011/0083476 | A1 * | 4/2011 | Yang | 68/12.02 |
| 2011/0265271 | A1 * | 11/2011 | Kim et al. | 8/137 |
| 2012/0210753 | A1 * | 8/2012 | Chung et al. | 68/17 R |
| 2012/0312594 | A1 * | 12/2012 | Hapke et al. | 174/668 |

* cited by examiner

APPARATUS TO DETECT OPENING AND CLOSING OF DOOR IN WASHING MACHINE

CROSS-REFERENCE TO RELATED APPLICATIONS

This application claims the benefit of Korean Patent Application No. 10-2013-0073600, filed on Jun. 26, 2013 in the Korean Intellectual Property Office, the disclosure of which is incorporated herein by reference.

BACKGROUND

1. Field

Embodiments of the present disclosure relate to an apparatus to detect opening and closing of a door in a washing machine capable of detecting opening and closing of a door in a washing machine depending upon a lever position of a door lock switch.

2. Description of the Related Art

In general, a washing machine (for instance, a fully automatic washing machine) is an apparatus including a water container to store water (wash water or rinse water), a washing tub which is rotatably installed inside the water container to receive laundry, a pulsator which is rotatably installed inside the washing tub to generate a water stream, and a motor which generates drive force to rotate the washing tub and the pulsator, thereby washing laundry by eliminating stains on the laundry by surface active action of a water stream and detergent.

Such a washing machine includes an inlet through which laundry is put into or taken out of the washing tub, and a door which is hinge-coupled to the washing machine so as to open and close the inlet. Accordingly, when the inlet is opened by pivoting of the door, a user may insert or withdraw laundry.

In addition, a door lock switch by which the door is locked so as not to be able to be opened and closed during operation of the washing machine is installed to a top cover at which the door is seated.

The door lock switch should simultaneously perform a door lock/unlock function and a power on/off function to control a power source of an electronic component. This enables the electronic component to operate only when the door is locked, thereby protecting a user from other safety accidents as well as from mechanical operations such as rotation of the washing tub and the pulsator.

This door lock switch allows on/off detection to be realized through a lock/unlock contact and it is detected as one of three conditions of "lock", "unlock", and "over travel" depending upon a position of a lever. In this case, if it is detected as over travel, it is determined that the door is opened.

Accordingly, when the door is closed, the lever of the door lock switch protrudes to be locked into the door, thereby allowing the door to be fixed together with the top cover (in the door lock condition). At this time, when the door is not fully closed, this is detected by the lever protruding to lock the door and a lock error is indicated so that the electronic component may not operate, for user safety.

As such, when the door is not closed, it is not possible to turn on the power source of the electronic component in order to prevent PL (Product Liability) accidents in advance.

However, moisture permeates into a component of the door lock switch due to environmental conditions surrounding the washing machine or a difference in steam or outdoor temperature by operation of a heater. In this case, the moisture also permeates into lock/unlock contact portions, thus resulting in an error in on/off detection through the lock/unlock contact. For instance, when the moisture permeates into the lock/unlock contact portions in the door lock condition, a short circuit occurs between the lock and unlock contacts, thereby allowing not only a lock signal but also an unlock signal to be detected together. As a result, even though the door is locked, erroneous detection may indicate that the door is unlocked.

SUMMARY

Therefore, it is an aspect of the present disclosure to provide an apparatus to detect opening and closing of a door in a washing machine capable of detecting opening and closing of a door by detecting a resistance value varying according to a lever position of a door lock switch.

Additional aspects of the disclosure will be set forth in part in the description which follows and, in part, will be apparent from the description, or may be learned by practice of the disclosure.

In accordance with one aspect of the present disclosure, an apparatus to detect opening and closing of a door in a washing machine includes a door to open and close an inlet of a washing machine, a door lock switch including a locking lever to lock or unlock the door by moving depending upon opening and closing of the door, and a variable resistance meter to output a resistance value of which varies according to movement of the locking lever, a detection unit which detects and outputs a voltage value applied to the variable resistance meter depending upon variation of a resistance value, and a control unit which determines a movement position of the locking lever depending upon the output voltage value of the detection unit and detects an opening and closing state of the door depending upon the movement position of the locking lever.

The door may further include a block member to block the movement of the locking lever, and the block member may have a structure which is provided integrally with the door at a front inner side of the door.

The locking lever may be moved so as to be blocked by or decoupled from the block member.

The apparatus to detect opening and closing of a door in a washing machine may further include a top cover forming the inlet of the washing machine, and the door may have a structure in which the door is hinge-coupled at one side of the top cover so as to open and close the inlet.

The door lock switch may be installed at one side of the top cover at which the door is seated.

The door lock switch may further include a pinion which is connected to the locking lever and rotates depending upon the movement of the locking lever, and a gear which engages with the pinion and rotates depending upon rotation of the pinion.

The variable resistance meter may be connected to the gear and the resistance value of the variable resistance meter may vary according to an angle of rotation of the pinion.

The detection unit may include surge suppression resistors R1 to R4 which limit current in order to detect the voltage value varying according to the resistance value of the variable resistance meter, and an integrator which outputs the voltage value applied to the variable resistance meter according to the variation of the resistance value.

The control unit may store data to determine the movement position of the locking lever depending upon the output voltage value of the detection unit.

The control unit may store data to detect the opening and closing state of the door depending upon the movement position of the locking lever.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
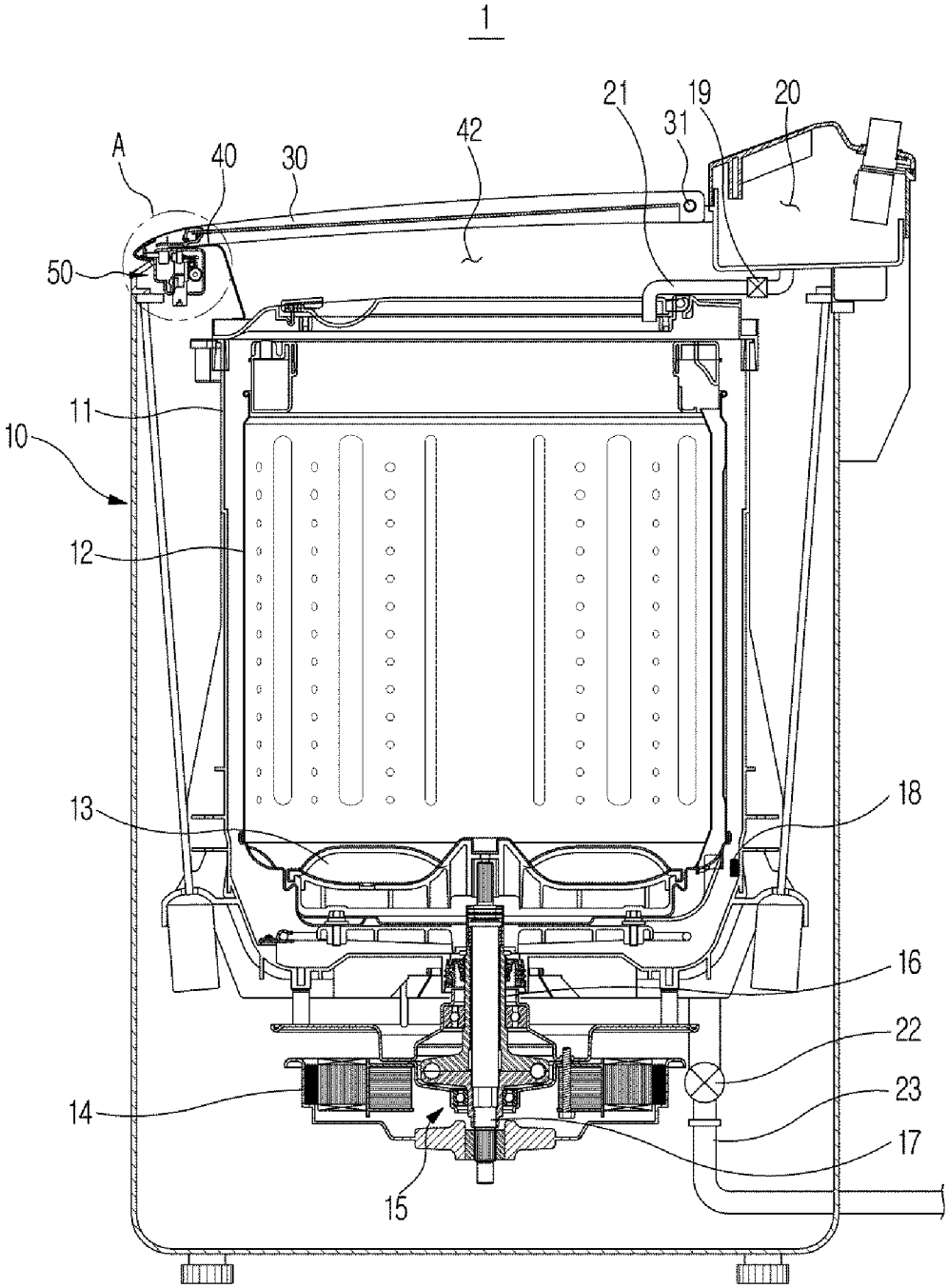
FIG. 1 is a view illustrating a closed state of a door in a washing machine according to an embodiment of the present disclosure.

Reference will now be made in detail to an embodiment of the present disclosure, examples of which are illustrated in the accompanying drawings, wherein like reference numerals refer to like elements throughout.

Figure 2:
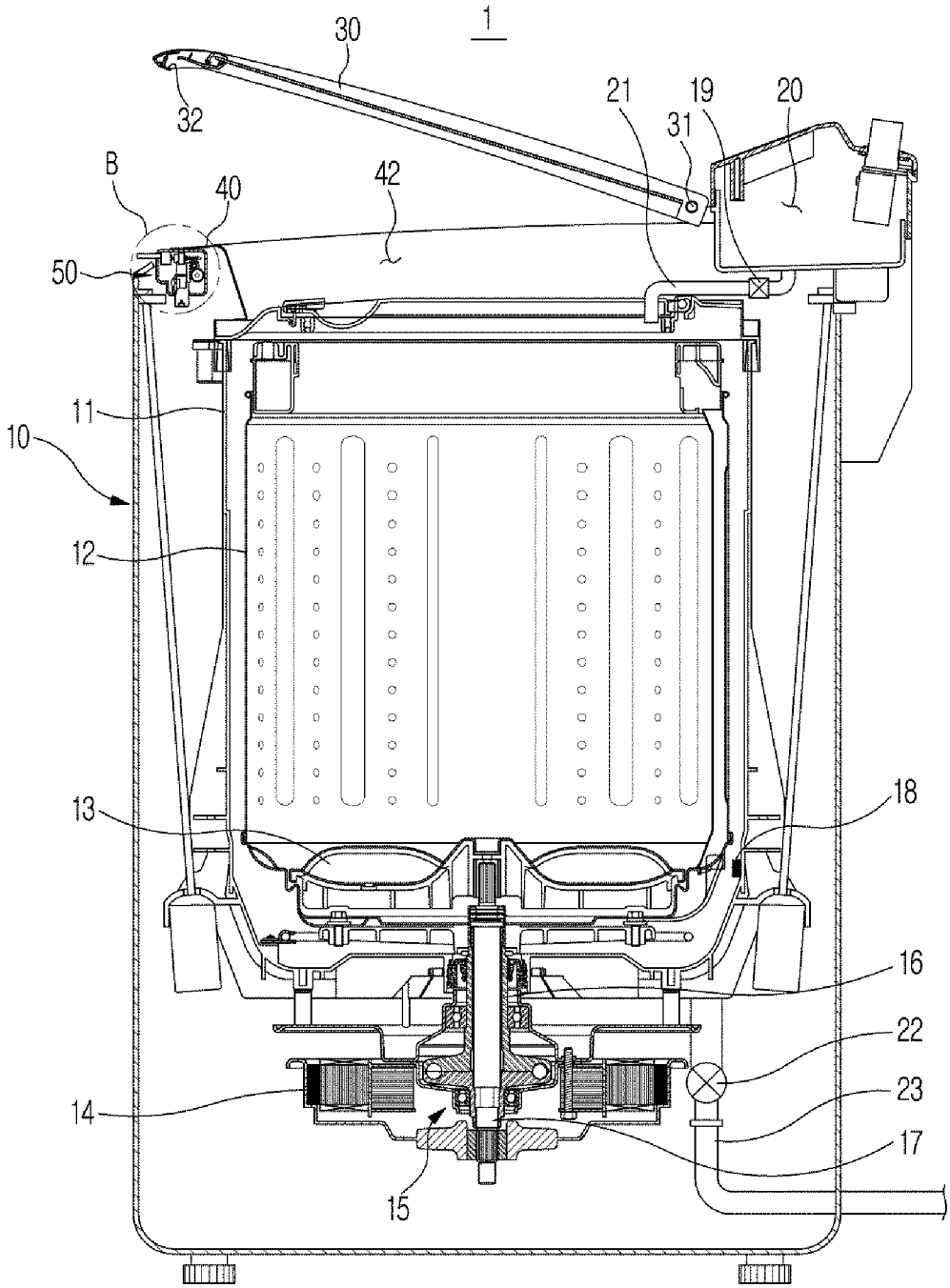
FIG. 2 is a view illustrating an opened state of the door in the washing machine according to the embodiment of the present disclosure.

FIG. 1 is a view illustrating a closed state of a door in a washing machine according to an embodiment of the present disclosure. FIG. 2 is a view illustrating an opened state of the door in the washing machine according to the embodiment of the present disclosure.

As shown in FIGS. 1 and 2, a washing machine 1 according to an embodiment of the present disclosure includes a main body 10 defining an external appearance thereof and having a substantial box shape, a water container 11 installed inside the main body 10 to store water (wash water or rinse water), and a washing tub 12 rotatably installed inside the water container 11 to receive laundry.

A pulsator 13 is rotatably installed at a bottom of the washing tub 12 to generate a water stream by clockwise rotation or counterclockwise rotation (forward rotation or reverse rotation), and has a vertical shaft.

The water container 11 is provided, at a lower outside thereof, with a motor 14 which generates drive force to rotate the washing tub 12 and the pulsator 13, and a power switching unit 15 which transfers the drive force generated by the motor 14 to the washing tub 12 and the pulsator 13.

The motor 14 is a direct drive motor having a variable speed function, and selectively transfers drive force to the washing tub 12 or the pulsator 13 depending upon upward and downward movement of the power switching unit 15. Reference numeral 16 denotes a hollow dehydration shaft connected to the washing tub 12, and reference numeral 17 denotes a washing shaft installed in the hollow portion of the dehydration shaft 16 so as to be connected to the pulsator 13 by passing through the water container 11 and the dehydration shaft 16.

In addition, the motor 14 is a universal motor configured by a field coil and an armature, but may also be a BLDC (Brushless Direct Motor) motor configured by a permanent magnet and an electromagnet. Furthermore, any motor may also be utilized as long as the motor 14 is applicable to the washing machine 1. In addition to this, the motor 14 may also be configured as a belt type motor.

The water container 11 is provided, at a lower inside thereof, with a water level sensor 18 which senses a frequency varying according to a water level in order to sense an amount of water (water level) in the water container 11.

In addition, the water container 11 is provided, at an upper portion thereof, with a water supply valve 19 and a detergent box 20 to supply the water container 11 with water and detergent, and the water supply valve 19 is mounted in the middle of a water supply pipe 21 to supply water into the water container 11 and controls supply of water. The water container 11 is provided, at a lower portion thereof, with a drain valve 22 and a drain pipe 23 to discharge water within the water container 11.

Furthermore, the main body 10 is provided, at an upper portion thereof, with a door 30 to open and close an upper surface of the main body 10. The main body 10 is provided, at an upper side thereof, with a top cover 40 which is detached or attached depending upon whether or not the door 30 is opened and closed. The top cover 40 is formed with an inlet 42 through which laundry may be put into or taken out of the washing tub 12.

Meanwhile, the door 30 is hinge-coupled so as to open and close the inlet 42 by a hinge member 31 arranged at one side of the door 30.

The door 30 is provided, at a front inner side thereof, with a block member 32 which blocks a locking lever 51 from advancing farther forward during closing of the door 30.

In addition, a door lock switch 50 by which the door 30 is locked so as not to be able to be opened and closed during operation of the washing machine 1 is installed at a front one side of the top cover 40 at which the door 30 is seated.

In general, a fully automatic washing machine has a structure in which the door 30 is installed at an upper portion of the top cover 40 to be opened and closed upward. On the other hand, a drum washing machine has a structure in which the door 30 is installed at a front surface of an outer case to be opened and closed forward.

In an embodiment of the present disclosure, a fully automatic washing machine will be described as an example, and a structure of the door lock switch 50 in the fully automatic washing machine will be described in detail with reference to FIG. 3.

Figure 3:
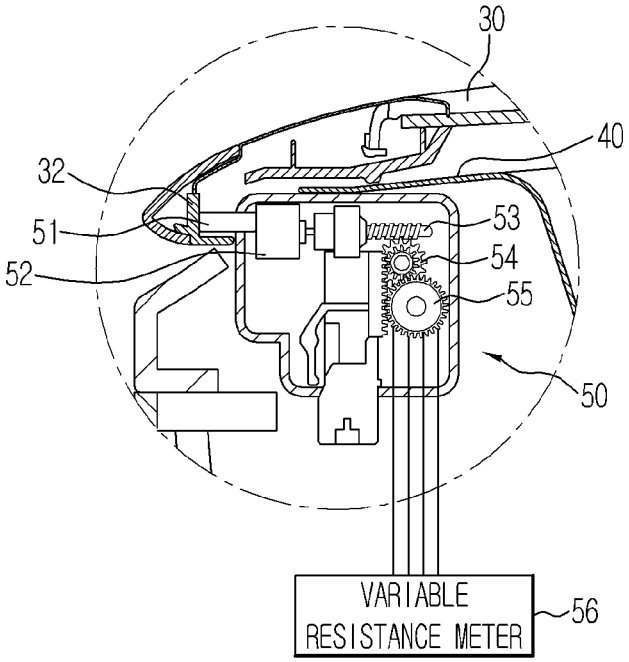
FIG. 3 is an enlarged view of portion "A" in FIG. 1.
Figure 4:
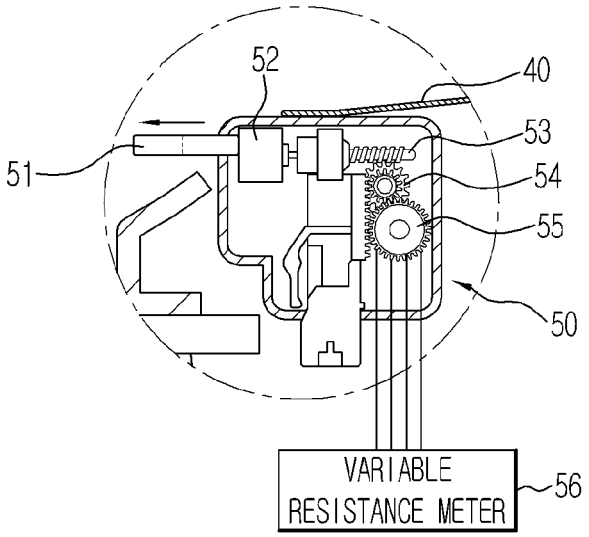
FIG. 4 is an enlarged view of portion "B" in FIG. 2.

FIG. 3 is an enlarged view of portion "A" in FIG. 1. FIG. 4 is an enlarged view of portion "B" in FIG. 2.

As shown in FIGS. 3 and 4, the door lock switch 50 includes a locking lever 51 to lock or unlock the door 30 by moving forward or rearward depending upon the opening and closing of the door 30, a sliding portion 52 which reciprocatingly slides so as to elastically correspond to movement of the locking lever 51 depending upon the opening and closing of the door 30, a threaded gear 53 which is connected to a rod of the sliding portion 52 and rotates according to movement of the locking lever 51, a pinion 54 which engages with the threaded gear 53 and rotates, and a variable gear 55 which engages with the pinion 54 and rotates depending upon rotation of the pinion 54.

In addition, the door lock switch 50 further includes a rotary type variable resistance meter 56 which is connected to a tip end of the variable gear 55 and a resistance value of which varies according to an angle of rotation of the pinion 54.

The variable resistance meter 56 outputs a resistance value according to a movement position of the locking lever 51 using the resistance value varying according to movement of the locking lever 51.

Accordingly, when a user opens and closes the door 30 for use of the washing machine 1, the locking lever 51 which is protrudingly provided at the door lock switch 50 moves forward or rearward depending upon the opening and closing of the door 30. The locking lever 51 is moved forward or rearward (or left or right) depending upon the opening and closing of the door 30.

When the locking lever 51 is moved, the sliding portion 52 reciprocatingly slides so as to elastically correspond according to the opening and closing of the door 30 so as to rotate the threaded gear 53, and the pinion 54 engaged with the threaded gear 53 is rotated according to rotation of the threaded gear 53, and thus the resistance value of the variable resistance meter 56 varies. In this case, the resistance value of the variable resistance meter 56 varying according to the angle of rotation of the pinion 54 is detected so as to detect whether or not the door 30 is opened and closed and an open state (a state in which the door is not fully closed, that is a state in which the door is closed but not locked) of the door 30.

As such, the movement position of the locking lever 51 is changed depending upon an opening and closing degree of the door 30, and the block member 32 blocks the locking lever 51 from advancing farther forward during closing of the door 30.

Hereinafter, a description will be given in detail with reference to FIG. 5 with respect to a circuit to detect an opening and closing state of the door 30 by detecting the resistance value of the variable resistance meter 56 varying according to the opening and closing of the door 30.

Figure 5:
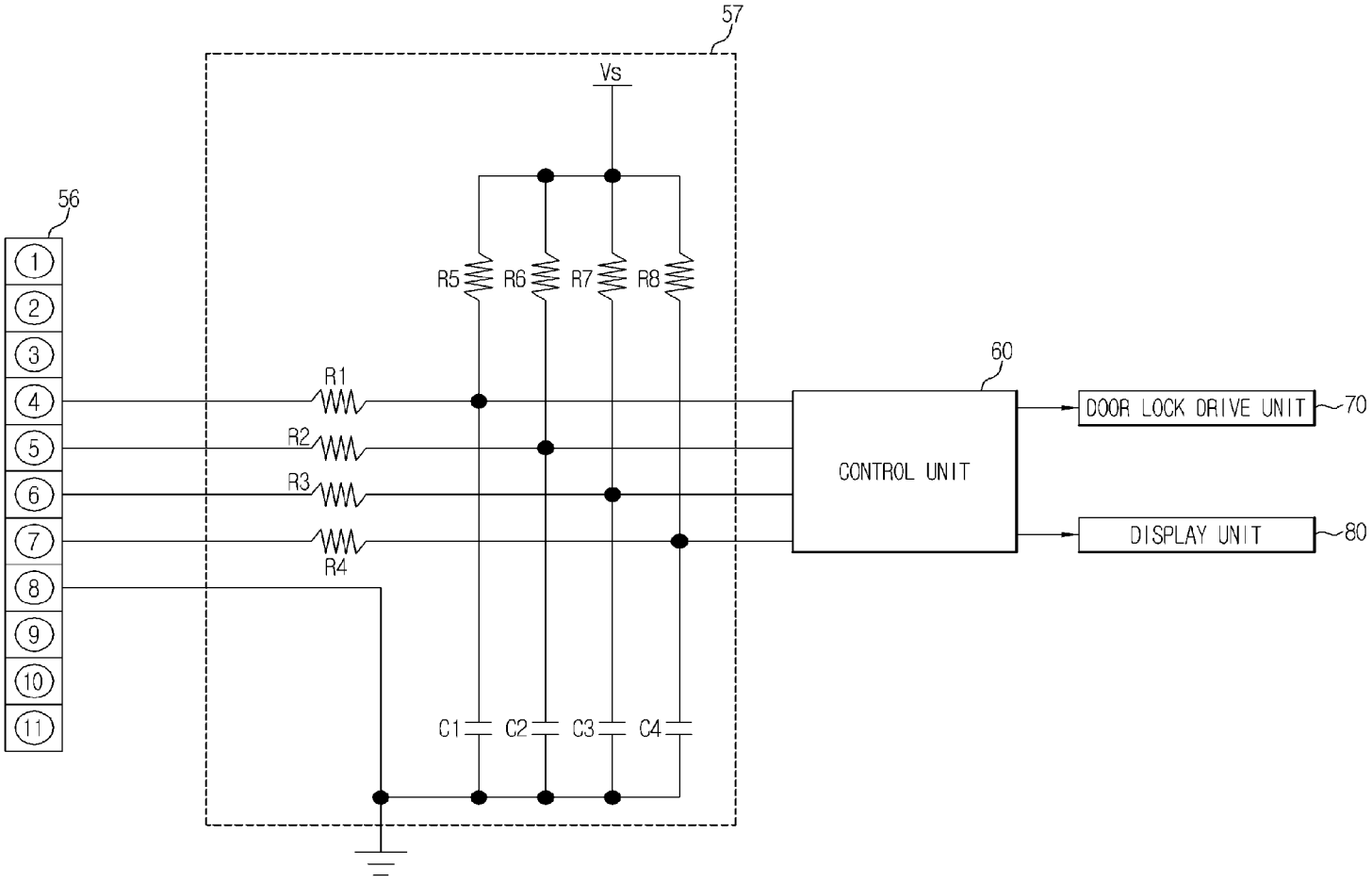
FIG. 5 is a control circuit diagram of an apparatus to detect opening and closing of a door in a washing machine according to the embodiment of the present disclosure.

FIG. 5 is a control circuit diagram of an apparatus to detect opening and closing of a door in a washing machine according to the embodiment of the present disclosure.

As shown in FIG. 5, the apparatus to detect opening and closing of a door in a washing machine according to the embodiment of the present disclosure includes a variable resistance meter 56 a resistance value of which varies according to the opening and closing of the door 30, a detection unit 57 which detects voltage applied to the variable resistance meter 56 according to variation of the resistance value so as to output a voltage value according to the movement position of the locking lever 51, a control unit 60 which determines the movement position of the locking lever 51 depending upon the voltage value output from the detection unit 57 and simultaneously detects the lock/unlock operation of the door 30 and the opening and closing state of the door 30 according to the determined movement position of the locking lever 51, a door lock drive unit 70 which operates the door lock switch 50 so as to control a power source of an electronic component depending upon a door lock control signal of the control unit 60, and a display unit 80 to display an operation state of the washing machine 1 depending upon a display control signal of the control unit 60.

The detection unit 57 includes surge suppression resistors R1 to R4 which limit current flowing in a condenser in order to detect the voltage value varying according to the resistance value of the variable resistance meter 56, and an RC integrator which outputs the voltage value applied to the variable resistance meter 56 according to variation of the resistance value. The RC integrator includes pull-up resistors R5 to R8 and noise suppression condensers C1 to C4.

The control unit 60 determines the movement position of the locking lever 51 depending upon a door opening and closing signal input via the detection unit 57 to detect an opening and closing state of the door 30, namely whether or not the door 30 is opened and closed and an open state (a state in which the door is not fully closed, that is a state in which the door is closed but not locked) of the door 30, and controls operation of the door lock switch 50 through the door lock drive unit 70 according to the detected opening and closing state of the door 30.

For example, when the door 30 is detected as being closed, the control unit 60 controls lock operation of the door 30 through the door lock drive unit 70 in order to lock the door 30 and controls driving of the motor 14 in order to operate the washing machine 1.

In addition, when the door 30 is detected as being opened, the control unit 60 controls unlock operation of the door 30 through the door lock drive unit 70 in order to unlock the door 30 and controls driving of the motor 14 in order to stop the washing machine 1.

The door lock drive unit 70 operates a door lock relay which controls current flow of an electronic component (a heater, a valve, or the like) so as to control a power source of the electronic component depending upon the opening and closing of the door 30.

The display unit 80 displays an operation state of the washing machine 1 such that a user recognizes the operation state of the washing machine 1 depending upon the display control signal of the control unit 60. The display unit 80 displays an error message such as in a case where a user operates the washing machine 1 in an opened state of the door 30, in a case where the door 30 is forcibly opened during operation of the washing machine 1, or the like.

Hereinafter, a description will be given of an operation process and an effect of the apparatus to detect opening and closing of a door in a washing machine according to the embodiment of the present disclosure.

A user opens the door 30 of the washing machine 1, puts laundry into the washing tub 12 through the inlet 42, and then closes the door 30. When the door 30 is closed, the door 30 is seated on the top cover 40 installed at the upper side of the main body 10 to close the inlet 42.

Then, a user manipulates buttons arranged on a control panel of the washing machine 1 and selects a washing course (for example, a standard course) depending upon a type of laundry. At this time, operating information of the washing course selected by a user is input to the control unit 60.

Accordingly, the control unit 60 operates the motor 14 depending upon the input operating information to control operation of the washing machine 1.

When the motor 14 is driven, washing is performed via a series of processes such as a washing process, a rinse process, and a dehydration process while the washing tub 12 or the pulsator 13 rotates by being driven by the motor 14.

However, when a user operates the washing machine 1 in a state in which the door 30 is not fully closed, there is a risk of safety accident.

Thus, the control unit 60 should detect whether or not the washing machine 1 is operated by a user in the state in which the door 30 is not fully closed. To this end, whether or not the door 30 is opened and closed is detected using the lever position of the door lock switch 50 installed at one side of the top cover 40.

In a case where a user operates the washing machine 1 in the state in which the door 30 is not fully closed, since the block member 32 provided at the front inner side of the door 30 is decoupled from the locking lever 51, the movement position of the locking lever 51 varies according to an opened level of the door 30.

When the movement position of the locking lever 51 varies according to the opened level of the door 30, the sliding portion 52 reciprocatingly slides to elastically correspond according to the opened level of the door 30 so as to rotate the threaded gear 53, and the pinion 54 engaged with the threaded gear 53 is rotated according to the rotation of the threaded gear 53, and thus the resistance value of the variable resistance meter 56 varies. In this case, by detecting the resistance value of the variable resistance meter 56 varying according to the angle of rotation of the pinion 54, a position of the locking lever 51 is determined.

That is, when the resistance value of the variable resistance meter 56 varies according to the opened level of the door 30, the detection unit 57 detects the voltage value applied to the variable resistance meter 56 according to the varied resistance value. In this case, the voltage value detected by the detection unit 57 is changed to an output voltage value depending upon the resistance value of the variable resistance meter 56 within a range of an input voltage (3.3V) in the GND, and the output voltage value is transferred to the control unit 60.

Accordingly, the control unit 60 determines the movement position of the locking lever 51 depending upon the output voltage value transferred from the detection unit 57. In this case, standard data of the output voltage value to determine movement position of the locking lever 51 is stored in advance.

When the movement position of the locking lever 51 is determined, the control unit 60 detects the opening and closing state of the door 30 (specifically, the open state of the door 30) depending upon the movement position of the locking lever 51. In this case, standard data to detect the opening and closing state of the door 30 depending upon the movement position of the locking lever 51 is stored in advance.

As such, when the open state of the door 30 is detected depending upon the movement position of the locking lever 51, the control unit 60 determines that the door 30 is opened during operation of the washing machine 1, thereby stopping the motor 14 in order to halt operation of the washing machine 1.

Then, the control unit 60 displays an error message indicating that the door 30 is open during operation of the washing machine 1 through the display unit 80 such that a user is able to close the door 30.

Meanwhile, although the fully automatic washing machine has been described as an example in the embodiment of the present disclosure, the present disclosure is not limited thereto. Of course, the same purpose and effect as the present disclosure may be achieved with respect to a drum washing machine.

As is apparent from the above description, in accordance with an apparatus to detect opening and closing of a door in a washing machine, when a contact on/off method is changed to a resistance meter method, a resistance meter is added to the inside of a component with the contact being eliminated therefrom. Accordingly, it may be possible to simplify an inner structure of the component and to reduce material costs. In addition, opening and closing of a door is accurately detected as a resistance value of the resistance meter varies by rotation of a gear instead of surface contact between contacts, and thus it may be possible to prevent a detection error in the event of contact short circuits due to moisture and to enhance component reliability.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An apparatus to detect opening and closing of a door in a washing machine comprising:

a door configured to open and close an inlet of a washing machine;

a door lock switch comprising a locking lever to lock or unlock the door by moving depending upon opening and closing of the door, and a variable resistance meter to output a resistance value of which varies according to movement of the locking lever;

a detection unit which detects and outputs a voltage value applied to the variable resistance meter depending upon variation of the resistance value; and a control unit which determines a movement position of the locking lever depending upon the output voltage value of the detection unit and detects an opening and closing state of the door depending upon the movement position of the locking lever.

2. The apparatus according to claim 1, wherein the door further comprises a block member to block the movement of the locking lever; and the block member has a structure which is provided integrally with the door at a front inner side of the door.

3. The apparatus according to claim 2, wherein the locking lever is moved so as to be blocked by or decoupled from the block member.

4. The apparatus according to claim 1, further comprising a top cover forming the inlet of the washing machine, wherein the door has a structure in which the door is hinge-coupled at one side of the top cover so as to open and close the inlet.

5. The apparatus according to claim 4, wherein the door lock switch is installed at one side of the top cover at which the door is seated.

6. The apparatus according to claim 1, wherein the door lock switch further comprises a pinion which is connected to the locking lever and rotates depending upon the movement of the locking lever, and a gear which engages with the pinion and rotates depending upon rotation of the pinion.

7. The apparatus according to claim 6, wherein the variable resistance meter is connected to the gear and the resistance value of the variable resistance meter varies according to an angle of rotation of the pinion.

8. The apparatus according to claim 7, wherein the detection unit comprises a plurality of surge suppression resistors which limit current in order to detect the voltage value varying according to the resistance value of the variable resistance meter, and an integrator which outputs the voltage value applied to the variable resistance meter according to the variation of the resistance value.

9. The apparatus according to claim 1, wherein the control unit stores data to determine the movement position of the locking lever depending upon the output voltage value of the detection unit.

10. The apparatus according to claim 9, wherein the control unit stores data to detect the opening and closing state of the door depending upon the movement position of the locking lever.

11. A door configured to open and close an inlet of a washing machine, comprising:

a door lock switch comprising a locking lever to lock or unlock the door, and a variable resistance meter to output a resistance value which varies according to movement of the locking lever;

a detection unit to detect and output a voltage value applied to the variable resistance meter depending upon variation of the resistance value; and a control unit to receive the output voltage value and determine an opening and closing state of the door.

12. The door according to claim 11, wherein the door further comprises a block member to block the movement of the locking lever.

13. The door according to claim 12, wherein the locking lever is moved so as to be blocked by or decoupled from the block member.

14. The door according to claim 11, wherein the door lock switch further comprises a pinion which is connected to the locking lever and rotates depending upon the movement of the locking lever, and a gear which engages with the pinion and rotates depending upon rotation of the pinion.

15. The door according to claim 14, wherein the variable resistance meter is connected to the gear and the resistance value of the variable resistance meter varies according to an angle of rotation of the pinion.

16. The door according to claim 15, wherein the detection unit comprises a plurality of surge suppression resistors which limit current in order to detect the voltage value varying according to the resistance value of the variable resistance meter, and an integrator which outputs the voltage value applied to the variable resistance meter according to the variation of the resistance value.

* * * * *